US007191871B2

(12) United States Patent
Nakai et al.

(10) Patent No.: US 7,191,871 B2
(45) Date of Patent: Mar. 20, 2007

(54) LUBRICATING DEVICE FOR ENGINE

(75) Inventors: Kazuyuki Nakai, Saitama (JP); Toru Oshita, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 618 days.

(21) Appl. No.: 10/646,695

(22) Filed: Aug. 25, 2003

(65) Prior Publication Data

US 2004/0104074 A1 Jun. 3, 2004

(30) Foreign Application Priority Data

Sep. 11, 2002 (JP) ..... 2002-266072

(51) Int. Cl.
*F01M 1/04* (2006.01)

(52) U.S. Cl. ..... 184/6.5; 123/195 R

(58) Field of Classification Search ..... 184/6.5–6.8; 123/196 A, 196 R, 196 M
See application file for complete search history.

(56) References Cited

U.S. PATENT DOCUMENTS 3,741,342 A * 6/1973 Maddalozzo ..... 184/6.4
3,855,987 A * 12/1974 Green et al. ..... 123/196 R
4,538,565 A * 9/1985 Hidaka et al. ..... 123/196 R
4,616,610 A 10/1986 Ishida
4,708,095 A * 11/1987 Luterek ..... 123/41.42
5,078,106 A * 1/1992 Matsuo et al. ..... 123/196 R
5,778,847 A * 7/1998 Takahashi et al. ..... 123/195 P
5,887,565 A * 3/1999 Ozeki et al. ..... 123/196 R
6,260,533 B1 * 7/2001 Tanaka ..... 123/196 R
6,655,307 B2 * 12/2003 Gokan ..... 114/55.5
2001/0020560 A1 9/2001 Yasui et al.

FOREIGN PATENT DOCUMENTS

EP 0 368 478 A 5/1990
JP 08177484 A * 7/1996
JP 08232626 A 9/1996

* cited by examiner

*Primary Examiner*—Chong H. Kim
(74) *Attorney, Agent, or Firm*—Birch, Stewart, Kolasch & Birch, LLP

(57) ABSTRACT

A sub-gallery for leading oil to a cylinder head side of an engine is provided in a crankcase in such a manner as to be connected to an outlet of an oil filter and in parallel with a main gallery. A lubricating device is also provided to equally feed oil to each of portions to be lubricated in the engine, including the main gallery connected to a discharge port of an oil pump via the oil filter. This lubricating device sufficiently feeds oil to even the cylinder head side of the engine while avoiding increased pressure loss of the oil.

10 Claims, 13 Drawing Sheets

LUBRICATING DEVICE FOR ENGINE

BACKGROUND OF THE INVENTION

CROSS-REFERENCES TO RELATED APPLICATIONS

This nonprovisional application claims priority under 35 U.S.C. § 119(a) on Patent Application No. 2002-266072 filed in Japan on Sep. 11, 2002, the entirety of which is herein incorporated by reference.

1. Field of the Invention

The present invention relates to an improved lubricating device for an engine, and more particularly to an improved lubricating device in which a main gallery is provided in a crankcase and is connected to a discharge port of an oil pump via an oil filter.

2. Description of the Background Art

A lubricating device of the background art has been shown and described in Japanese Patent Laid-open No. Hei 8-232626. The device is configured such that oil is supplied from an oil pump to a main gallery via an oil filter, and the oil is then fed from the main gallery to each of the portions of the engine requiring lubrication.

In the above-described lubricating device of the background art, a significant pressure loss of the oil is liable to occur since oil is fed to each of the portions to be lubricated. Accordingly, it is difficult to optimize the amount of oil to be fed to the portions to be lubricated in the engine. In particular, since an oil passage configuration for a cylinder head side of the lubricating system is relatively complicated, it is difficult to optimize the amount of oil to be fed to the portions requiring lubrication on the cylinder head side of the lubrication system.

SUMMARY OF THE INVENTION

The present invention overcomes the shortcomings associated with the background art and achieves other advantages not realized by the background art.

An object of the present invention is to provide a lubricating device for an engine that is capable of evenly feeding oil to each of portions to be lubricated in the engine in equal amounts or flow rates. Accordingly, oil is sufficiently and evenly fed even to the cylinder head side of the system while avoiding the significant pressure losses.

One or more of these and other objects are accomplished by a lubricating system for an engine, the lubricating system comprising an oil pump connected to an oil filter via a discharge port of the oil pump; a main gallery being connected to the discharge port of the oil pump via the oil filter, wherein the main gallery is provided in a crankcase of the engine; a sub-gallery for leading oil to a cylinder head side of the lubricating system, the sub-gallery being provided in the crankcase in such a manner as to be operatively connected to an outlet of the oil filter and in parallel to the main gallery, wherein oil flowing through the main gallery is in parallel flow to oil flowing in the sub-gallery.

One or more of these and other objects are further accomplished by a lubricating device for an engine having a crankcase, the lubricating device comprising an oil pump connected to an oil filter via a discharge port of the oil pump; a main gallery being connected to the discharge port of the oil pump via the oil filter, wherein the main gallery is provided in the crankcase of the engine; a sub-gallery for leading oil to a cylinder head side of the lubricating device, the sub-gallery being provided in the crankcase in such a manner as to be operatively connected to an outlet of the oil filter and in parallel to the main gallery, wherein oil flowing through the main gallery is in parallel flow to oil flowing in the sub-gallery.

Since oil to be fed on the cylinder head side is led by way of the sub-gallery, it is possible to divide the oil into at least two parts and feed the divided oil part to each of portions to be lubricated in the engine, and hence to equally feed oil to each of the portions to be lubricated in the engine. This is advantageous in sufficiently feeding oil even to the cylinder head side while avoiding the increased pressure losses of oil. In addition, the oil passage configuration from the sub-gallery to the cylinder head can be simplified by dedicating the sub-gallery as a passage specialized to feed oil to the cylinder head side.

The sub-gallery may also include a first passage portion extending in straight line so as to communicate the outlet of the oil filter to an oil cooler, and a second passage portion extending in straight line in the direction reversed to that of the first passage portion. It is also possible to facilitate the formation of the sub-gallery by simplifying the shape of the sub-gallery.

The sub-gallery, and the main gallery may be communicated to an outlet of the oil cooler provided in the crankcase in such a manner that the axes of the sub-gallery and the main gallery are parallel to the axis of the crankshaft. With this configuration, it is possible to facilitate the formation of the main gallery by simplifying the shape of the main gallery.

The center line of the sub-gallery, the center line of the main gallery, the center line of a communication passage for communicating the outlet of the oil cooler to the main gallery, and the center axes of the oil filter and the oil cooler may all be located within the same plane. With this configuration, it is possible to facilitate the formation of the oil passage configuration in the crankcase. In addition, a discharge passage for connecting the oil pump to the oil filter may be disposed beneath the main-gallery and the sub-gallery in such a manner that the axis of the discharge passage is perpendicular to the axes of the main-gallery and the sub-gallery. With this configuration, it is possible to compactly dispose the sub-gallery, the main gallery, and the discharge passage in the vertical direction.

Further, the oil filter and oil cooler may be mounted in parallel to an outer wall surface of the crankcase. With this configuration, it is possible to compactly mount the oil filter and the oil cooler on the crankcase by making the distance of the axes of the oil filter and the oil cooler as short as possible.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
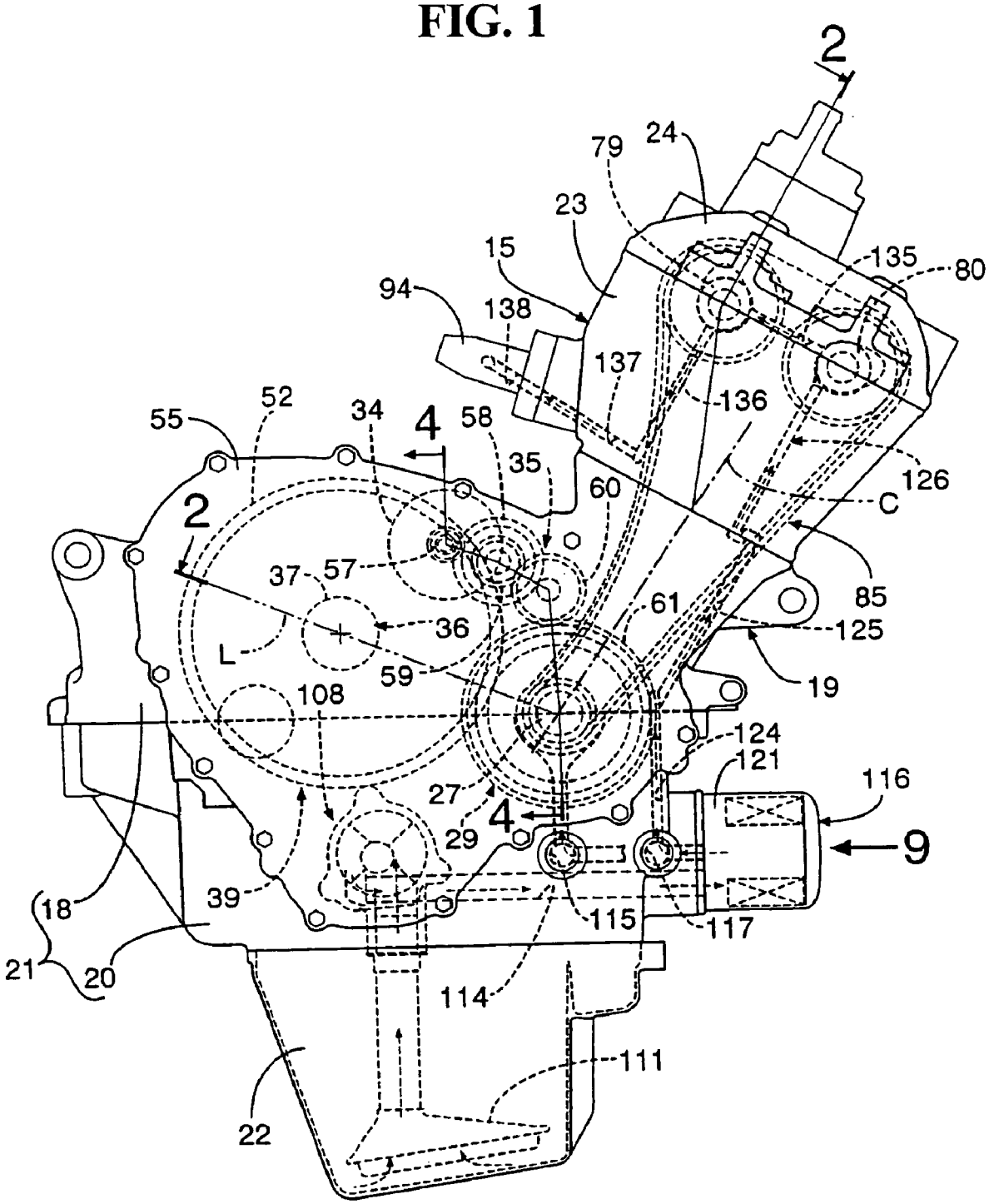
FIG. 1 is a side view of an engine according to an embodiment of the present invention.
Figure 2:
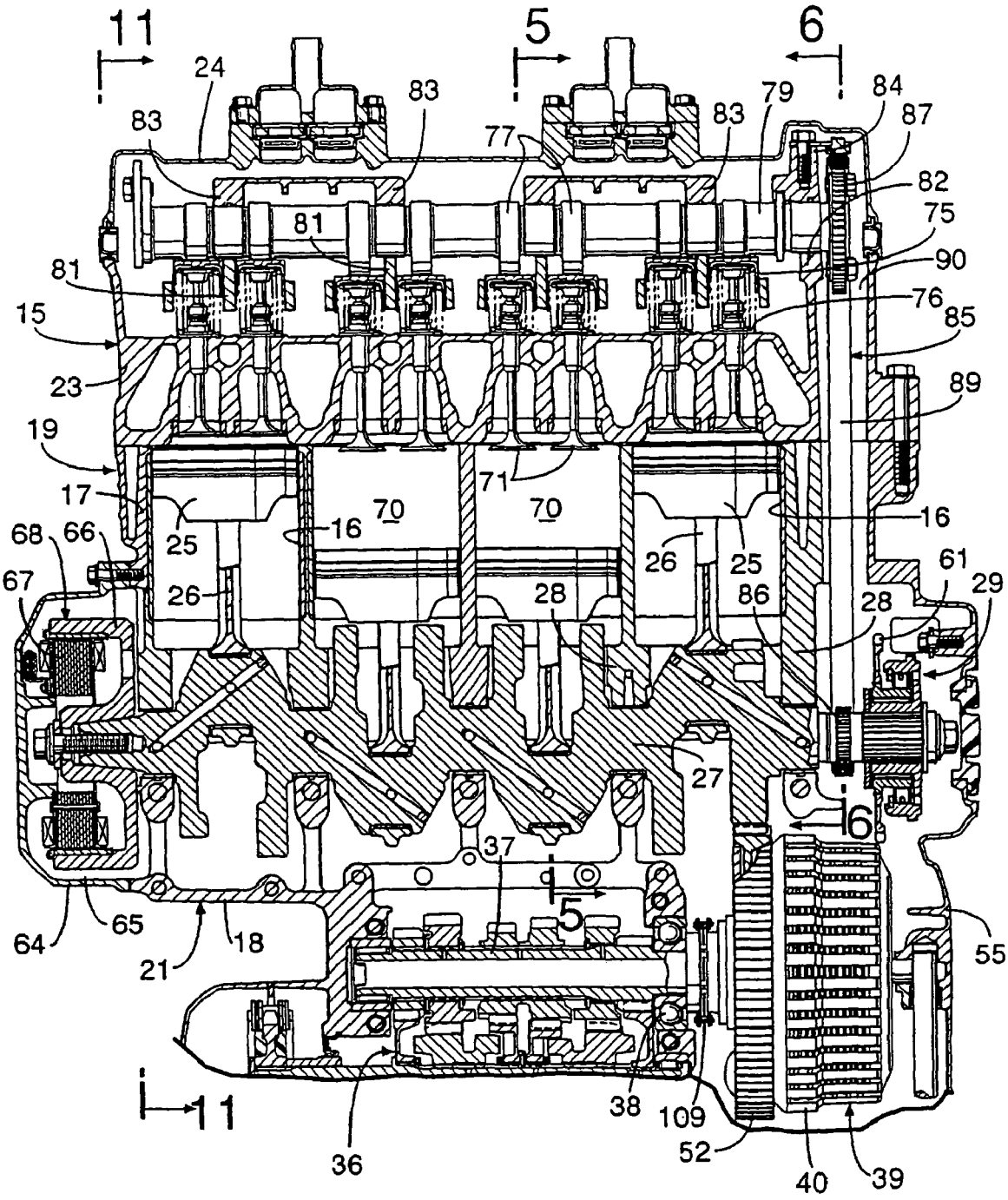
FIG. 2 is a sectional view taken along line 2—2 of FIG. 1.
Figure 3:
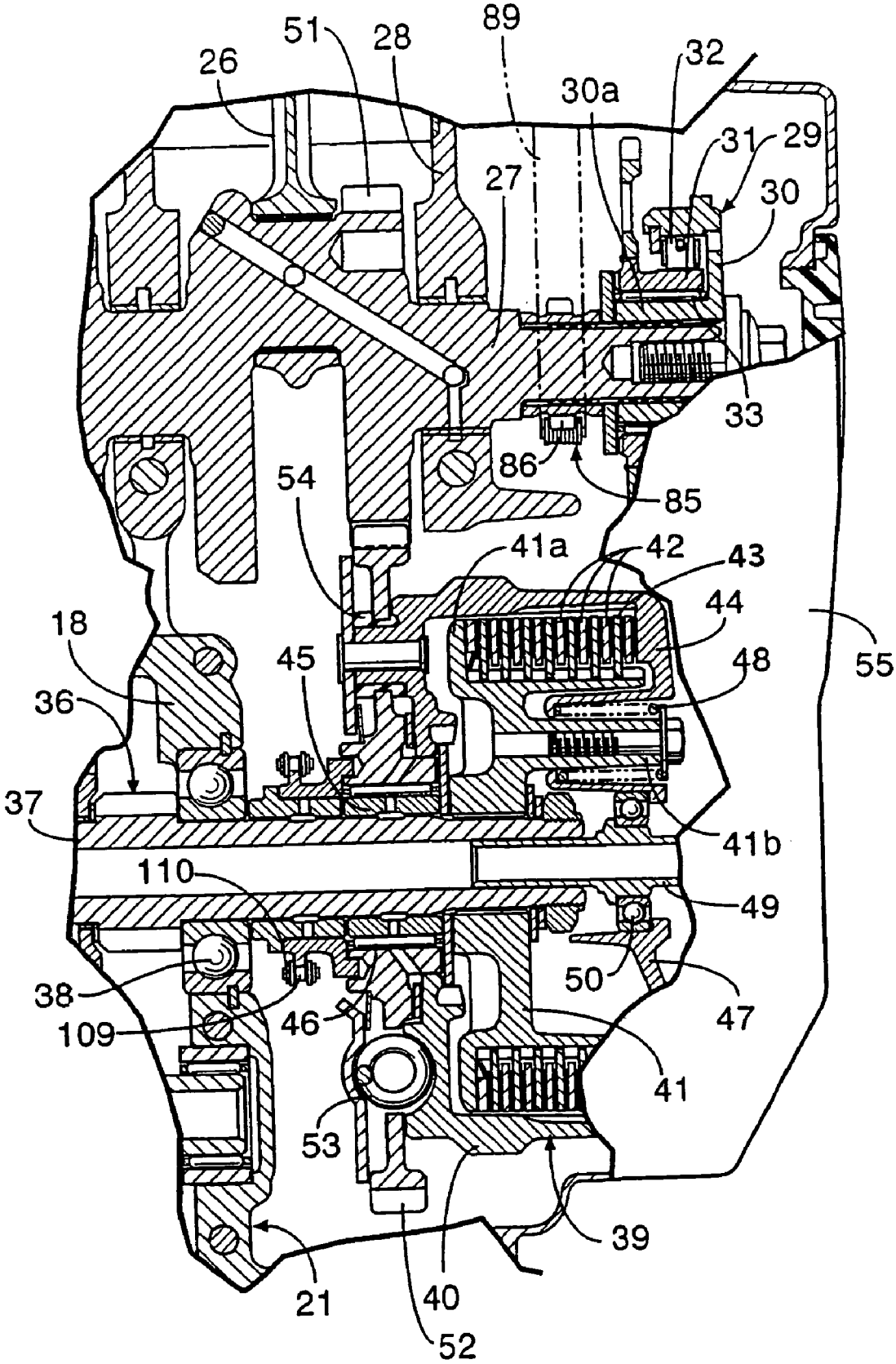
FIG. 3 is an enlarged view of a portion of the engine shown in FIG. 2.
Figure 4:
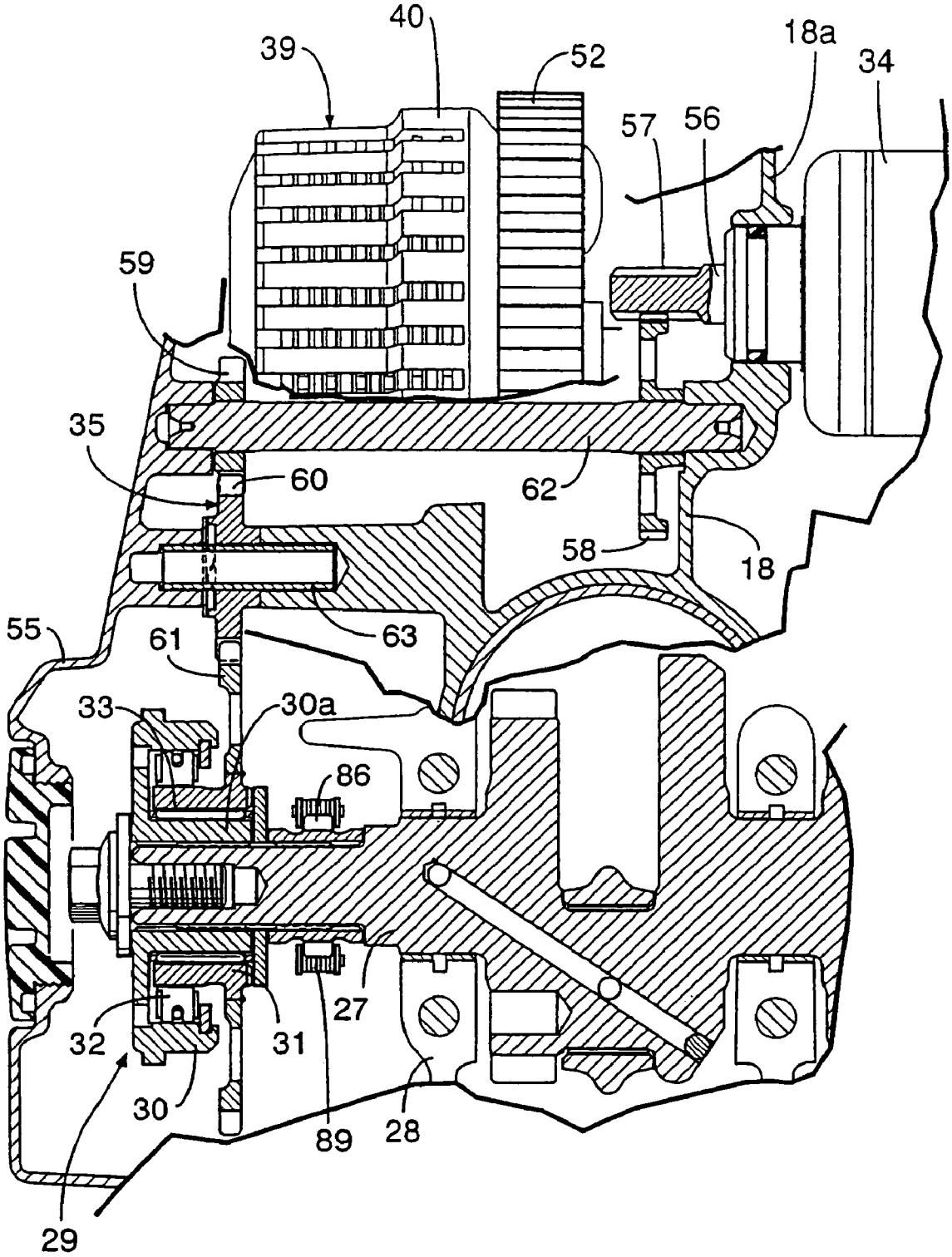
FIG. 4 is an enlarged sectional view taken along line 4—4 of FIG. 1.
Figure 5:
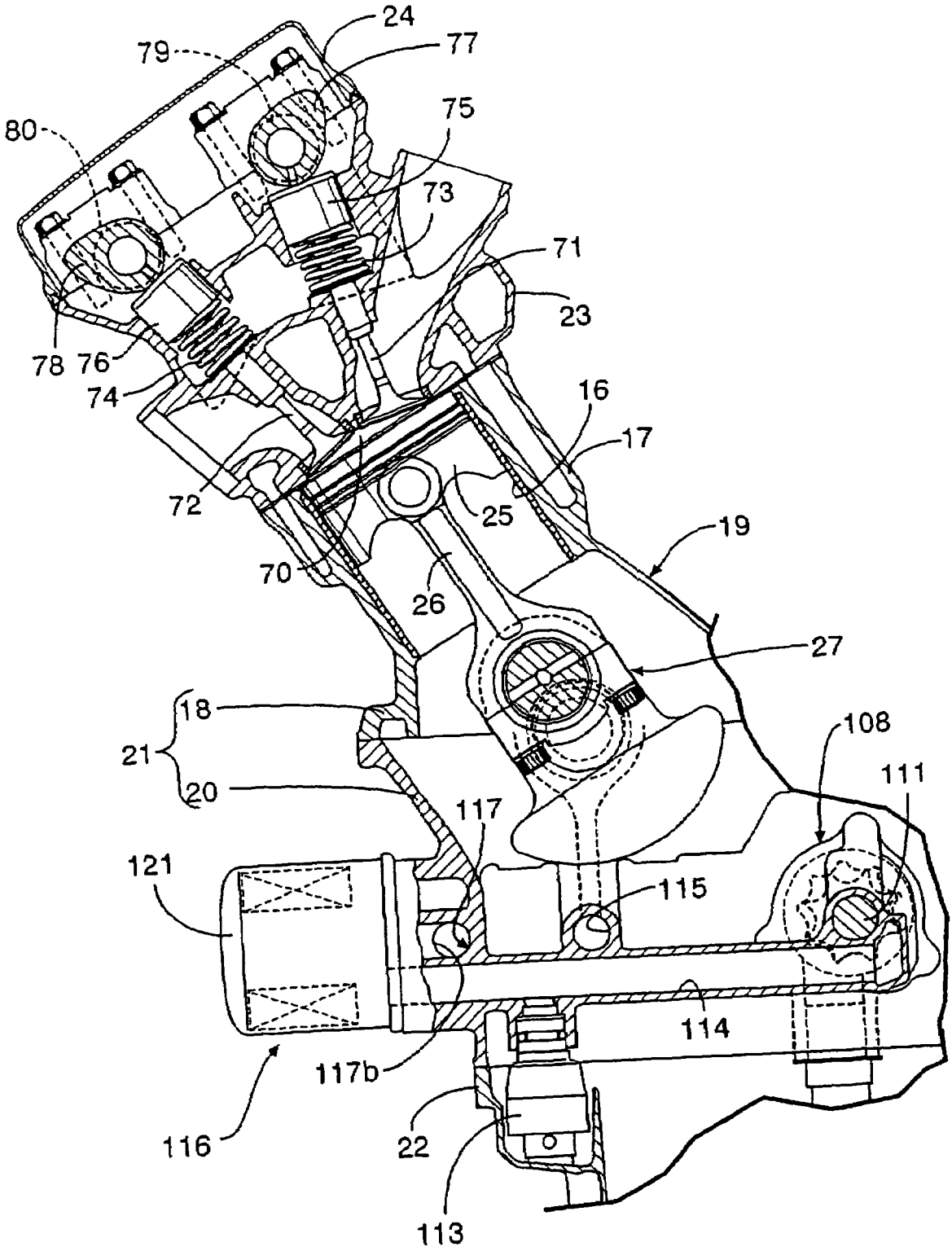
FIG. 5 is an enlarged sectional view taken along line 5—5 of FIG. 2.
Figure 6:
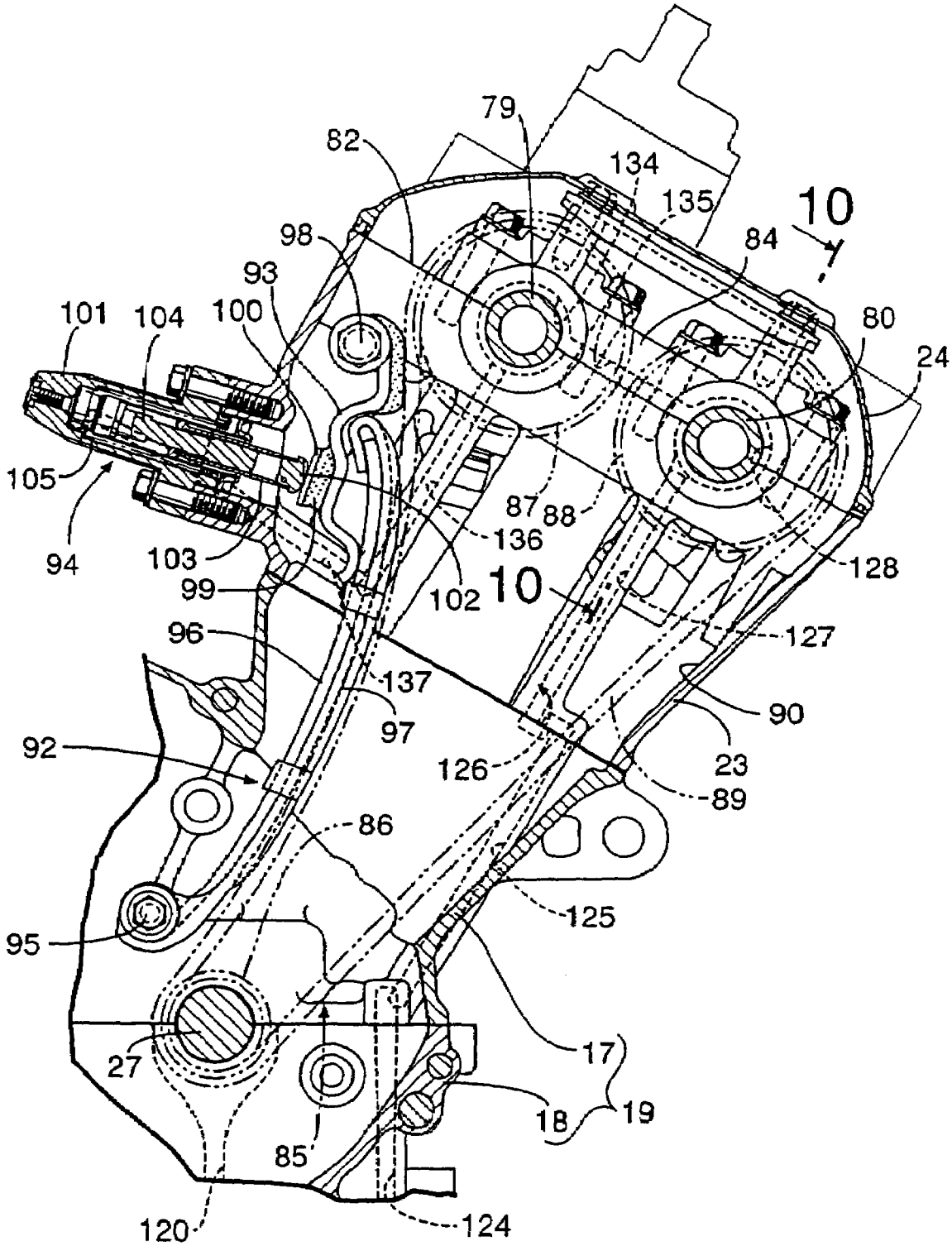
FIG. 6 is an enlarged sectional view taken along line 6—6 of FIG. 2.
Figure 7:
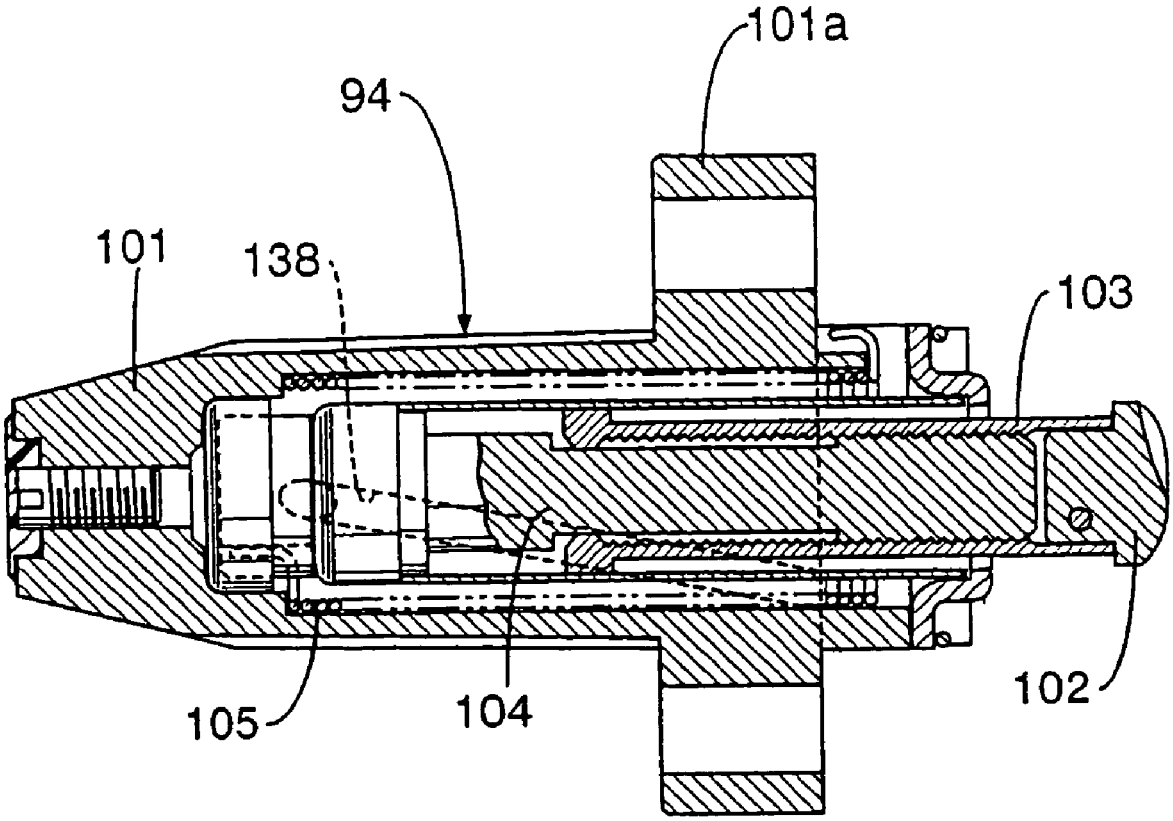
FIG. 7 is an enlarged longitudinal sectional view of a screw type lifter.
Figure 8:
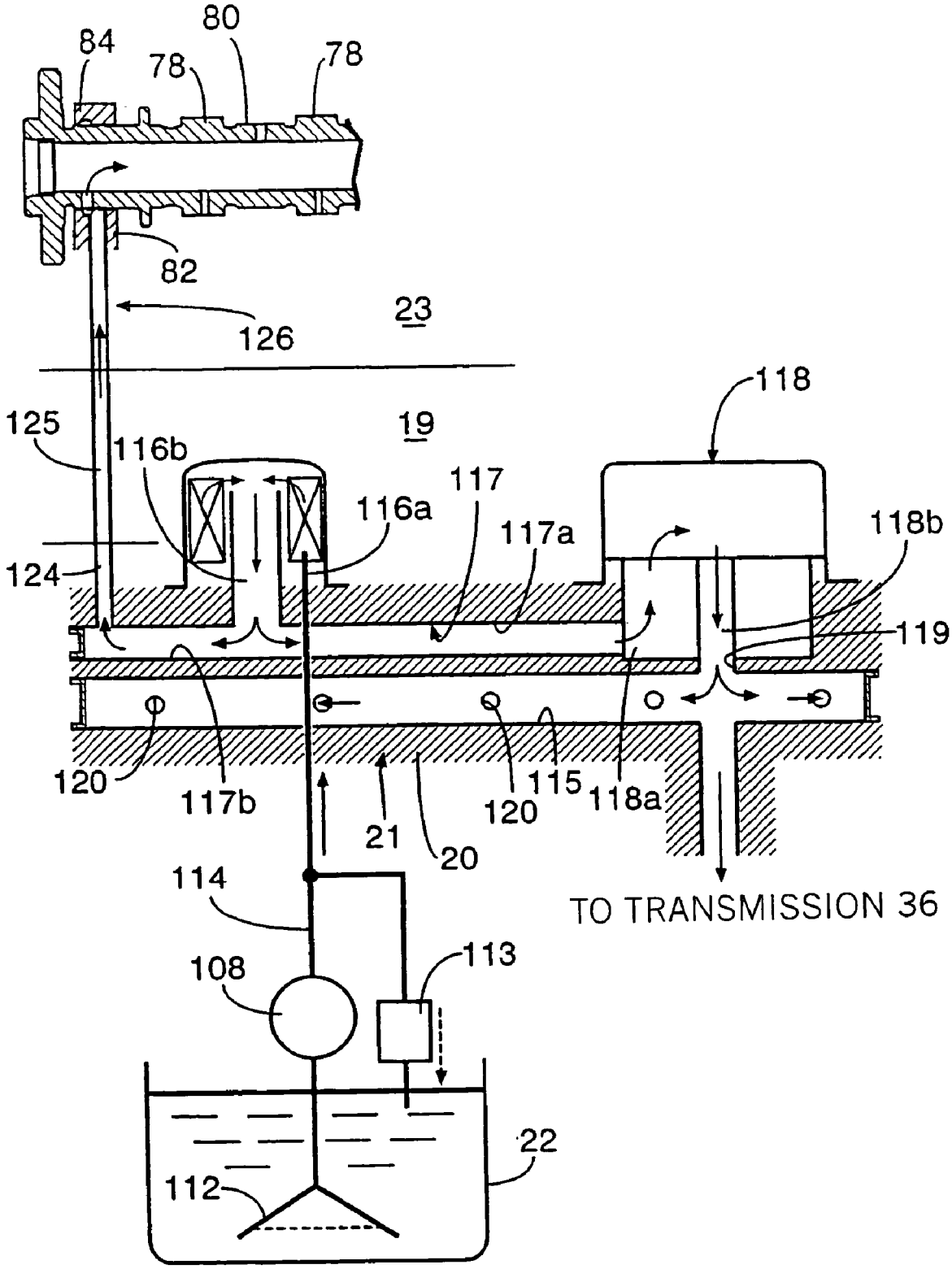
FIG. 8 is a schematic diagram showing oil feeding lines from an oil pump to a main gallery and a sub-gallery.
Figure 9:
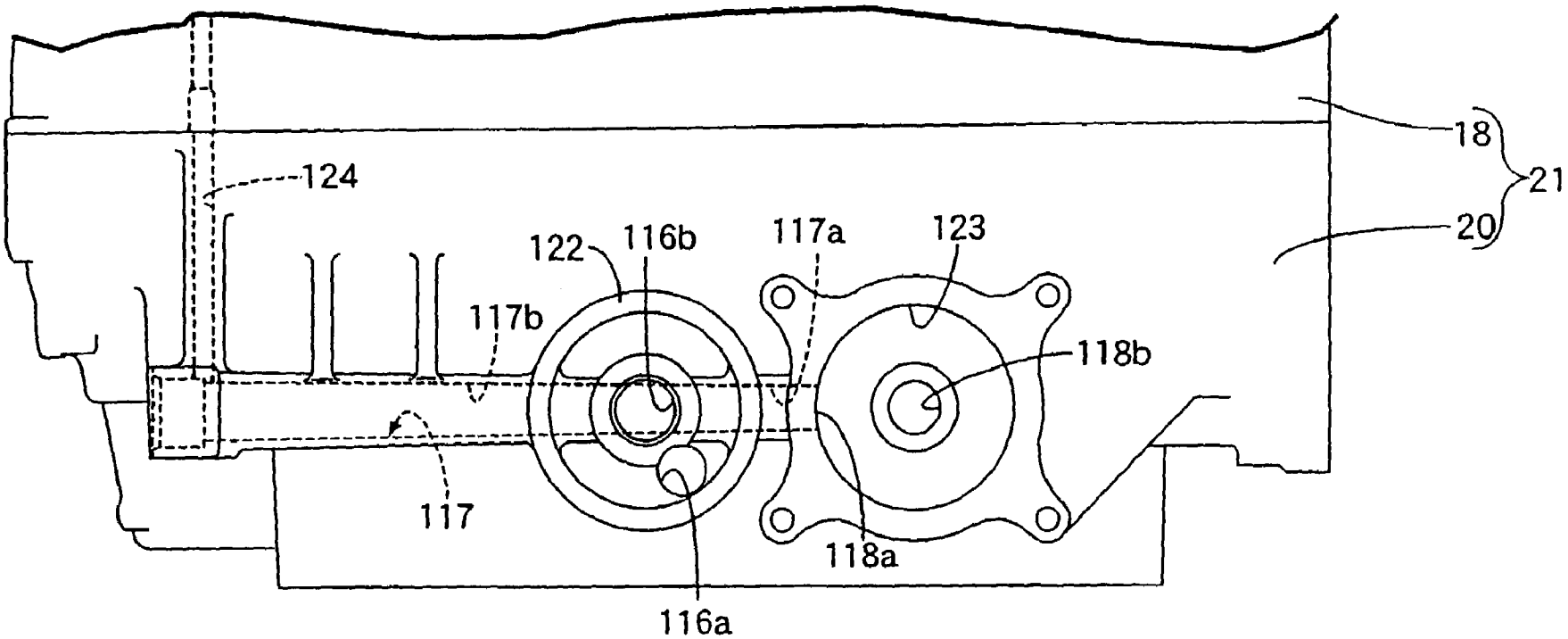
FIG. 9 is a view of a crankcase as seen along arrow 9 in FIG. 1.
Figure 10:
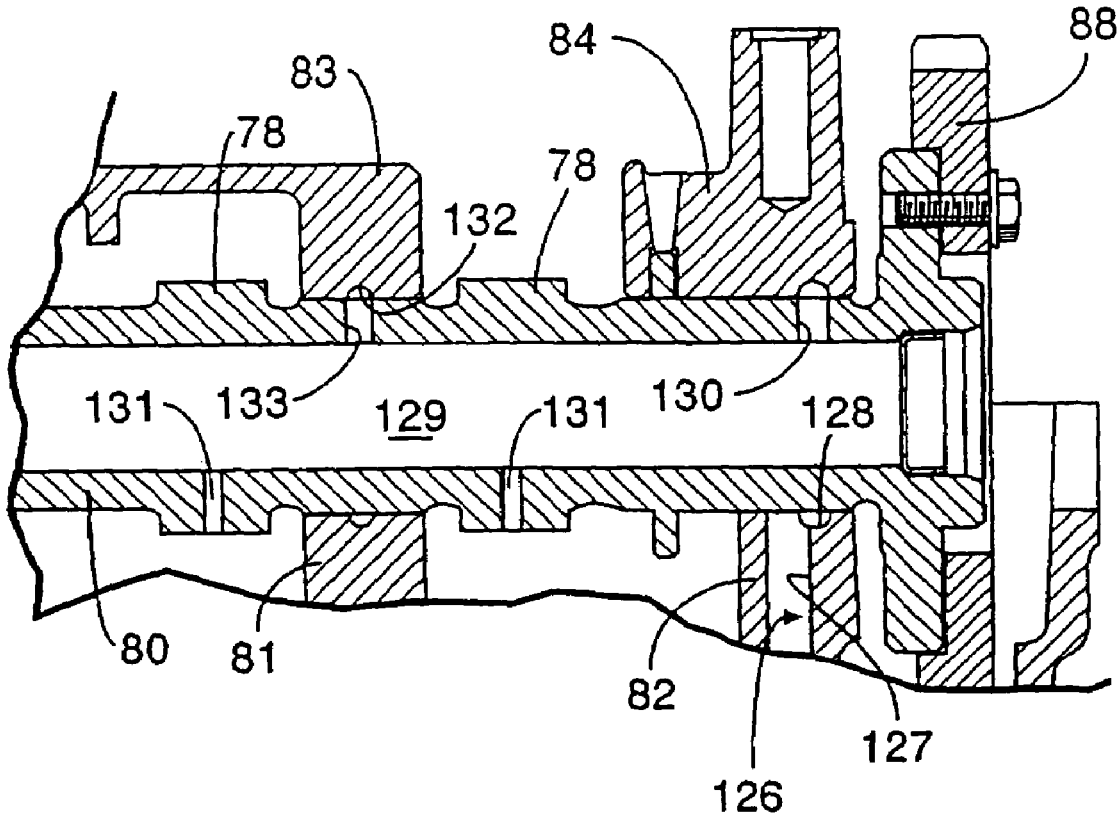
FIG. 10 is a sectional view taken along line 10—10 in FIG. 6.
Figure 11:
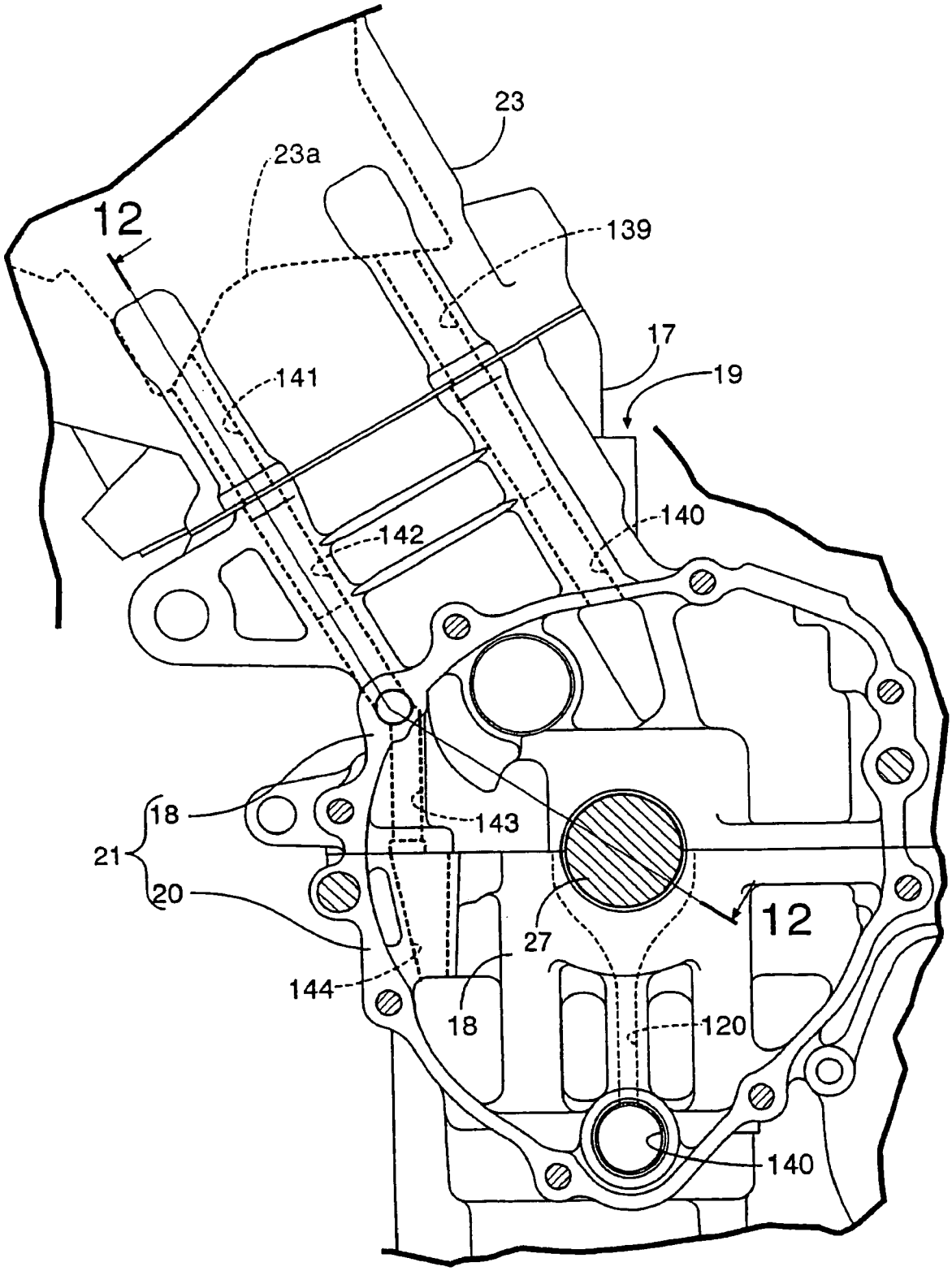
FIG. 11 is a sectional view taken along line 11—11 in FIG. 2.
Figure 12:
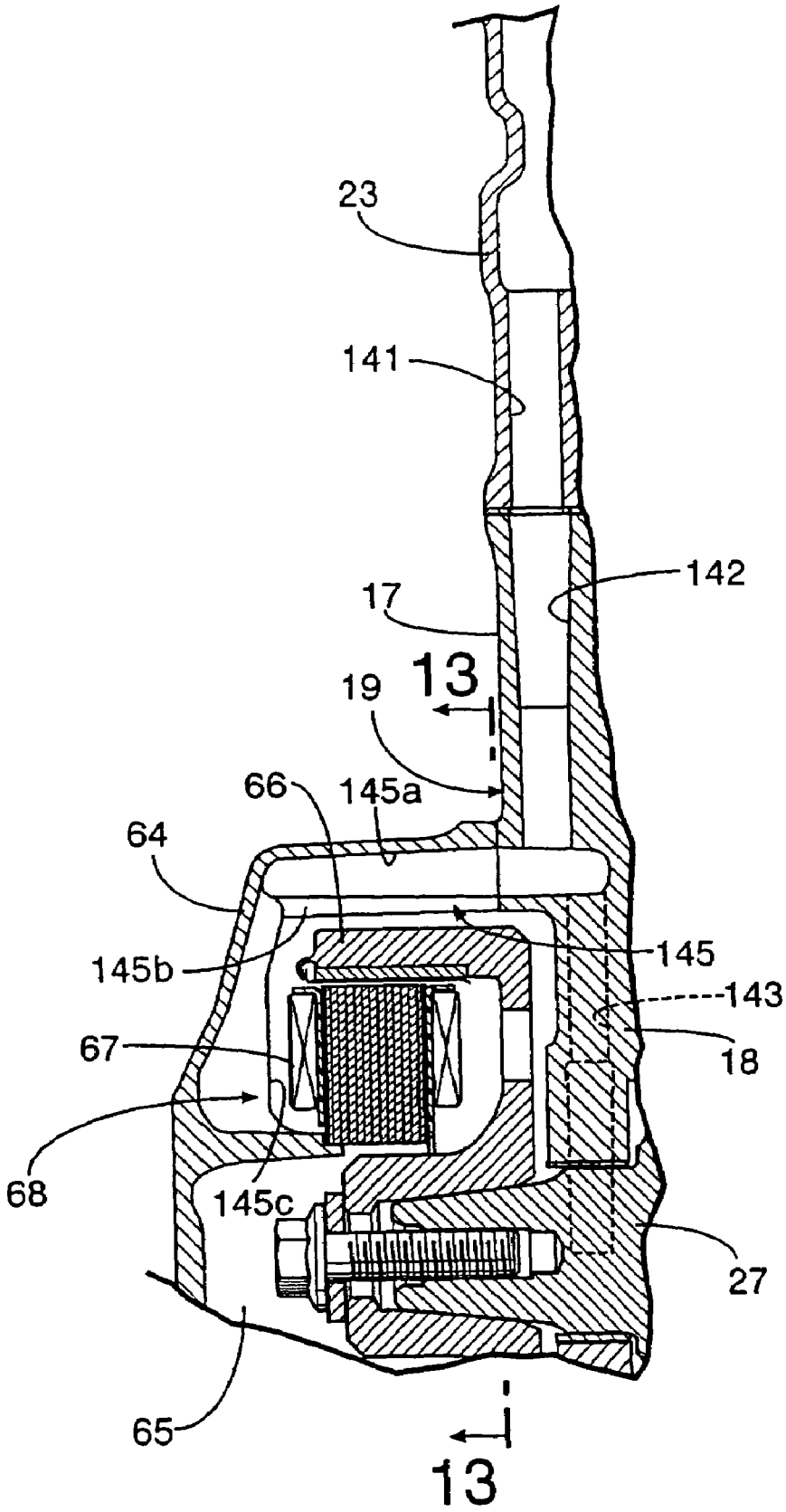
FIG. 12 is a sectional view taken along line 12—12 in FIG. 11.
Figure 13:
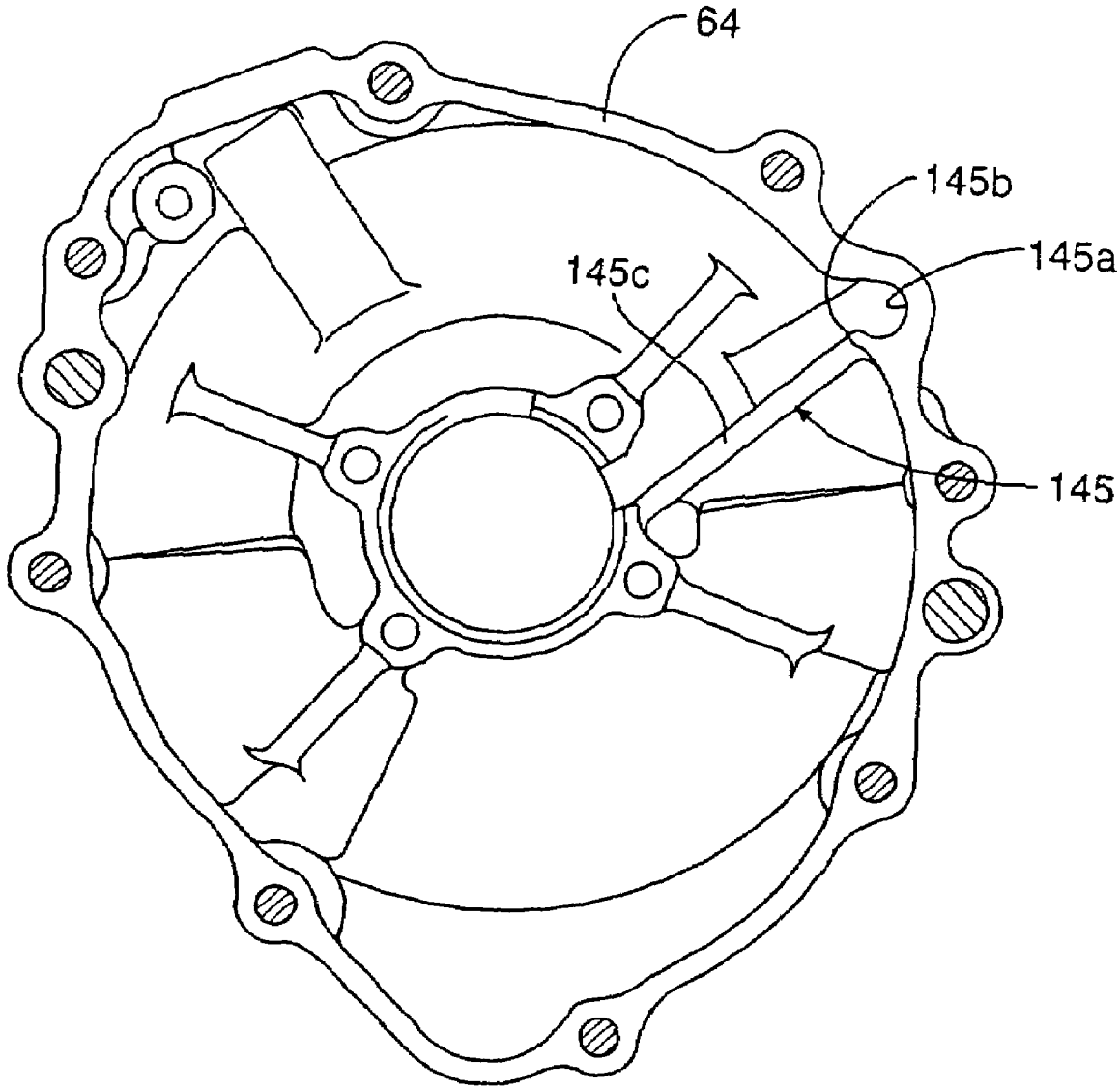
FIG. 13 is a view of a generator cover as seen along line 13—13 in FIG. 12.

The present invention will hereinafter be described with reference to the accompanying drawings. FIG. 1 is a side view of an engine according to an embodiment of the present invention. FIG. 2 is a sectional view taken along line 2—2 of FIG. 1. FIG. 3 is an enlarged view of a portion of the engine shown in FIG. 2. FIG. 4 is an enlarged sectional view taken along line 4—4 of FIG. 1. FIG. 5 is an enlarged sectional view taken along line 5—5 of FIG. 2. FIG. 6 is an enlarged sectional view taken along line 6—6 of FIG. 2. FIG. 7 is an enlarged longitudinal sectional view of a screw type lifter. FIG. 8 is a schematic diagram showing oil feeding lines from an oil pump to a main gallery and a sub-gallery. FIG. 9 is a view of a crankcase as seen along arrow 9 in FIG. 1. FIG. 10 is a sectional view taken along line 10—10 in FIG. 6. FIG. 11 is a sectional view taken along line 11—11 in FIG. 2. FIG. 12 is a sectional view taken along line 12—12 in FIG. 11. FIG. 13 is a view of a generator cover as seen along line 13—13 in FIG. 12.

An in-line, four-cylinder engine according to the present invention is shown in FIGS. 1 and 2. Such an engine, which is typically mountable on a motorcycle, includes an engine body 15 having a forwardly, and upwardly tilting cylinder axis C. The engine body 15 includes a cylinder block 19, a lower case 20, an oil pan 22, a cylinder head 23, and a head cover 24. The cylinder block 19 has a cylinder portion 17 having four cylinder bores 16 arranged in line and an upper case portion 18 integrally continuous with the bottom of the cylinder portion 17. The lower case 20 is joined to the bottom of the cylinder block 19 in such a manner as to form a crankcase 21 in cooperation with the upper case portion 18. The oil pan 22 is joined to the bottom of the lower case 20, e.g., the crankcase 21. The cylinder head 23 is joined to the top of the cylinder block 19. The head cover 24 is joined to the top of the cylinder head 23. Pistons 25 are slidably fitted in the cylinder bores 16 and are connected to a crankshaft 27 via connecting rods 26, respectively. The crankshaft 27 is rotatably supported by a plurality of crank journal walls 28 provided on the crankcase 21.

As particularly shown in FIGS. 3 and 4, an over-running clutch 29 is provided on a first end side of the crankshaft 27 in the axial direction (or on the front end side of the motorcycle along the running direction in this embodiment). Specifically, the front end portion of the crankshaft 27 projects from the crank journal wall 28 located on the front end side, and the over-running clutch 29 is mounted to the front end portion of the crankshaft 27.

The over-running clutch 29 is a type including a clutch outer 30, a clutch inner 31, and a plurality of sprags interposed between the clutch outer 30 and the clutch inner 31. The clutch outer 30 has cylindrical hubs 30*a* fixed to one end portion of the crankshaft 27. The clutch inner 31 is relatively rotatably supported by a needle bearing 33 interposed between the hub 30*a* and the clutch inner 31. When the clutch inner 31 is normally rotated, the sprags 32 are raised to connect the clutch inner 31 to the clutch outer 30.

A starting motor 34 is mounted to the upper case portion 18 of the crankcase 21 of the engine body 15. The over-running clutch 29 having a rotational axis parallel to that of the crankshaft 27 is adapted to input a rotational power of the starting motor 34 to the crankshaft 27. A starting gear reducer 35 is provided between the starting motor 34 and the over-running clutch 29. Power outputted from the crankshaft 27 is speed-reduced by a transmission 36, and is transmitted to a rear wheel, e.g., a drive wheel. A main shaft 37 of the transmission 36, which has an axis parallel to that of the crankshaft 27, is rotatably supported by the upper case portion 18 of the crankcase 21 via a ball bearing 38 or the like.

A starting clutch 39 interposed between the crankshaft 27 and the main shaft 37 is mounted to one end of the main shaft 37. The starting clutch 39 includes a clutch housing 40, a clutch center 41, a plurality of friction plates 42, a plurality of friction plates 43, and a pressing plate 44. The clutch housing 40, formed into a cylindrical shape with its bottom closed, is relatively rotatably supported by the main shaft 37. The clutch center 41 is coaxially contained in the clutch housing 40 in such a manner as to be fixed to the main shaft 37. The friction plates 42 are spline-fitted in the inner periphery of the clutch housing 40. The friction plates 43 are axially slidably fitted in the outer periphery of the clutch center 41 in such a manner as to alternately overlap the friction plates 42. The pressing plate 44 is provided for pressing the friction plates 42 and 43 to a pressure receiving plate 41*a* provided on the clutch center 41.

The clutch housing 40 is rotatably supported by a cylindrical sleeve 45 mounted to the main shaft 37 via a needle bearing 46. The clutch housing 40 is thus rotatable relative to the main shaft 37. The pressing plate 44 is integrally formed on a release plate 47. A plurality of supporting shafts 41*b* passing through the release plate 47 are integrally provided on the clutch center 41. Coil-shaped clutch springs 48, each surrounding the corresponding supporting shaft 41*b*, are interposed between the release plate 47 and the clutch center 41. The release plate 47 is rotatably supported by a release rod 49 via a release bearing 50. The release rod 49 is inserted in the main shaft 37 in such a manner as to be axially movable relative to the main shaft 37.

In response to axial movement of the release rod 49, the starting clutch 39 switches the states of connection and disconnection between the clutch housing 40 and the clutch center 41 to each other. In the connection state, the friction plates 42 and 43 are pressed between the pressure receiving plate 41*a* and the pressing plate 44, to connect the clutch center 41 to the clutch housing 40. In the disconnection state, the friction plates 42 and 43 are made free between the pressure receiving plate 41*a* and the pressing plate 44, to disconnect the clutch center 41 from the clutch housing 40.

A drive gear 51 is integrally formed on the crankshaft 27 at a position located inside the above-described crank journal wall 28 on the first end side of the crankshaft 27. A driven gear 52 meshing with the drive gear 51 is connected to the clutch housing 40 of the starting clutch 39 via a damper spring 53 and an elastic member 54. When the starting clutch 39 switches the disconnection state to the connection state, power from the crankshaft 27 is transmitted to the main shaft 37 via the drive gear 51, driven gear 52 and the starting clutch 39.

The over-running clutch 29 and the starting clutch 39 are located at positions projecting from side walls of the cylinder block 19 and the lower case 20 (on the right side wall of the motorcycle along the running direction in this embodiment) on the one end side of the crankshaft 27 in the axial direction. A cover 55 for covering the over-running clutch 29 and the starting clutch 39 is fastened to the side walls of the cylinder block 19 and the lower case 20.

A supporting wall 18*a* is provided on the upper case portion 18 of the crankcase 21 in such a manner as to be located at a position corresponding to an approximately central portion of the engine body 15 along the axis of the crankshaft 27. The starting motor 34 is mounted to the supporting wall 18*a*. In this case, on the figure projected on a plane perpendicular to the axis of the crankshaft 27, the starting motor 34 is disposed within a region surrounded by the cylinder axis C and a straight line L connecting the axis of the crankshaft 27 and the axis of the main shaft 37 to each other. Further, on the side view of the one end side of the crankshaft 27 in the axial direction, the starting motor 34 is disposed behind the starting clutch 39 in such a manner that part of the starting motor 34 overlaps the starting clutch 39. The starting motor 34 is disposed at an approximately central portion of the engine body 15 along the axis of the crankshaft 27 in such a manner as to sandwich the starting clutch 39 between the over-running clutch 29 and the starting motor 34 in the direction along the axis of the crankshaft 27.

The starting gear reducer 35 includes a pinion 57, a large-diameter gear 58, a small-diameter gear 59, an idle gear 60, and a ring gear 61. The pinion 57 is fixed to an output shaft 56 of the starting motor 34. The large-diameter gear 58 meshes with the pinion 57, the small-diameter gear 59 rotates integrally with the large-diameter gear 58, and the idle gear 60 meshes with the small-diameter gear 59. The ring gear 61 is fixed to the clutch inner 31 of the over-running clutch 29 in such a manner as to mesh with the idle gear 60. An output of the starting motor 34 is speed-reduced in three steps, that is, by a first reduction step between the pinion 57 and the large-diameter gear 58, a second reduction step between the small-diameter gear 59 and the idle gear 60, and a third reduction step between the idle gear 60 and the ring gear 61, and is transmitted to the crankshaft 27 via the over-running clutch 29. A rotational shaft 62 crossing the starting clutch 39 is rotatably supported by the supporting wall 18*a* and the cover 55. The large-diameter 58 and the small-diameter gear 59 are fixed to both ends of the rotational shaft 62, respectively. The idle gear 60 is rotatably supported by a supporting shaft 63 supported by the upper case portion 18 and the cover 55.

As shown in FIG. 2, a generator chamber 65 is formed by a side wall of the cylinder block 19 on the other side of the crankshaft 27 in the axial direction and a generator cover 64 fastened to the cylinder block 19. The other end portion of the crankshaft 27 projects into the generator chamber 65. In the generator chamber 65, a rotor 66 is fixed to the other end portion of the crankshaft 27. A stator 67 surrounded by the rotor 66 is fixed to the inner surface of the generator cover 64. The rotor 66 and the stator 67 form a generator 68.

As particularly shown in FIG. 5, combustion chambers 70, to each of which the top of the corresponding piston 25 faces, are formed between the cylinder portion 17 of the cylinder block 19 and the cylinder head 23. Intake valves 71 and exhaust valves 72 are mounted in the cylinder head 23 in such a manner that a pair of the intake valves 71 and exhaust valves 72 are disposed for each of the combustion chambers 70 in a position to be opened and closed. The intake valves 71 and the exhaust valves 72 are biased in the valve closed direction by spring forces of valve springs 73 and 74, respectively.

Each lifter 75 in contact with the top of the corresponding intake valve 71 is fitted in the cylinder head 23 in such a manner as to be slidable in the direction along the valve opening/closing direction, e.g., the axial direction of the intake valve 71. Similarly, each lifter 76 being in contact with the top of the corresponding exhaust valve 72 is fitted in the cylinder head 23 in such a manner as to be slidable in the direction along the valve opening/closing direction, that is, the axial direction of the exhaust valve 72.

An intake side cam 77 is in sliding-contact with the upper surface, opposite to the intake valve 71, of the corresponding lifter 75, and an exhaust side cam 78 is in sliding-contact with the upper surface, opposite to the exhaust valve 72, of the corresponding lifter 76. The intake side cams 77 are integrally provided on an intake side camshaft 79, and the exhaust side cams 78 are integrally provided on an exhaust side camshaft 80.

Cam journal walls 81, each of which is common to the intake side camshaft 79 and the exhaust side camshaft 80 and is disposed at a position corresponding to that of each combustion chamber 70, are integrally provided in the cylinder head 23. Similarly, a cam journal wall 82, which is common to the intake side camshaft 79 and the exhaust side camshaft 80 and is located on the one end side of the camshafts 79 and 80 along the axial direction, is integrally provided in the cylinder head 23. Four cam holders 83, each of which is common to the intake side camshaft 79 and the exhaust side camshaft 80, are fastened to the cam journal walls 81. A cam holder 84, which is common to the intake side camshaft 79 and the exhaust side camshaft 80, is fastened to the cam journal wall 82. The intake side camshaft 79 and the exhaust camshaft 80 are rotatably supported by the cam holders 83 and 84 and the cam journal walls 81 and 82. In addition, each pair of the cam holders 83 are integrated with each other.

As particularly shown in FIG. 6, a timing transmission 85 is provided for speed-reducing a rotational power of the crankshaft 27 in half and transmitting the resultant rotational power to the intake side camshaft 79 and the exhaust side camshaft 80. The timing transmission 85 includes a drive sprocket 86, a driven sprocket 87, a driven sprocket 88, and an endless cam chain 89. The drive sprocket 86 is fixed to the crankshaft 27 at a position between the crank journal wall 28 on the first end side of the crankshaft 27 in the axial direction and the over-running clutch 29. The driven sprocket 87 is fixed to one end of the intake side camshaft 79. The driven sprocket 88 is fixed to one end of the exhaust side camshaft 80. The endless cam chain 89 is wound around the sprockets 86, 87, and 88. The drive sprocket 86 and a lower portion of the cam chain 89 are contained between the cylinder block 19 and the cover 55. An upper portion of the cam chain 89 is contained and operable within a cam chain chamber 90 provided in the cylinder head 23.

A chain tensioner 91 including a tensioner arm 92, a control arm 93, and a tensioner lifter 94 is provided for giving a constant tension to a portion of the cam chain 89, e.g., on the loose side of the chain 89 on the side between the drive sprocket 86 and the driven sprocket 87. The tensioner arm 92 includes a tensioner arm body 96 and a shoe 97 made from a synthetic resin. The tensioner arm body 96 is swingably supported by the cylinder block 19 via a first pivot 95 located in the vicinity of the drive sprocket 86. The shoe 97 is mounted to the tensioner arm body 96 in such a manner as to be in sliding-contact with the outer surface of the portion, on the loosened side, of the cam chain 89. The tensioner arm body 96 is made from spring steel in the form of a strip arched to the outer surface of the portion of the cam chain 89, e.g., on the loose side of the chain 89. The shoe 97 is formed so as to cover the front surface of the tensioner arm body 96.

Similar to the tensioner arm body 96, the control arm 93 is made from spring steel. The base end of the control arm 93 is swingably supported by the cylinder head 23 via a second pivot 98 located in the vicinity of the driven sprocket 87. The swingable end of the control arm 93 comes into contact with the back surface of the swingable end of the tensioner arm body 96. A pressure receiving plate 100 is joined to the back surface of an intermediate portion of the control arm 93 via a cushion material such as rubber. The tensioner lifter 94 is mounted to the cylinder head 23 in such a manner as to bias the pressure receiving plate 100 to the tensioner arm 92 side.

As shown in FIG. 7, the tensioner lifter 94 is of a type that includes a lifter case 101, a hollow lifter rod 103, a screw shaft 104, and a torsional coil spring 105. The lifter case 101 has a flange 101*a* fastened to the cylinder head 23. The lifter rod 103 has at its leading end a pressing portion 102 adapted to be brought into contact with the pressure receiving plate 100. The lifter rod 103 is unrotatably supported in the lifter case 101 and the screw shaft 104 is screwed in the hollow portion of the lifter rod 103. The torsional coil spring 105 spirally biases, the screw shaft 104 in the advance direction of the lifter rod 103 within the lifter case 101. In this tensioner lifter 94, a torsional force of the torsional coil spring 105 is converted and amplified into a thrust load by the screw shaft 104. The thrust load of the screw shaft 104 biases the lifter rod 103 to the control arm 93 side.

An oil pump 108 having a rotational axis parallel to that of the crankshaft 27 is mounted to the lower case 20 of the crankcase 21. An endless chain 110 is wound around a sprocket 109 relatively stationary and engaged with the clutch housing 40 of the starting clutch 39 and a sprocket (not shown) fixed to a rotational shaft 111 of the oil pump 108.

As shown in FIG. 8, oil in the oil pan 22 is pumped up by an oil pump 108 via an oil strainer 112, and is discharged from the oil pump 108 to a discharge passage 114 provided in the lower case 20. A relief valve 113 is interposed between the discharge passage 114 and the oil pan 22, to keep the oil pressure in the discharge passage 114 at a constant value. Oil is then fed from a main gallery 115 to portions to be lubricated between the crank journal walls 18 and the crankshaft 27 and to the transmission 36. The main gallery 115 is provided in the lower case 20 of the crankcase 21. Specifically, the main gallery 115 is connected to a discharge port of the oil pump 108 via an oil filter 116 and an oil cooler 118. Passages 120 for leading oil to the portions to be lubricated between the crank journal walls 18 and the crankshaft 27 are provided in the lower case 20 in such a manner as to be communicated to the main gallery 115.

A sub-gallery 117 for leading oil to the cylinder head 23 side is provided in the lower case 20 of the crankcase 21. The sub-gallery 117 is connected to an outlet 116*b* of the oil filter 116 in parallel to the main gallery 115. The sub-gallery 117 includes a first passage portion 117*a* and a second passage portion 117*b*. The first passage portion 117*a* extends in straight line so as to communicate the outlet 116*b* of the oil filter 116 to the oil cooler 118. The second passage portion 117*b* extends in a straight line in the direction opposite to that of the first passage portion 117*a*. The discharge port 114 is connected to an inlet 116*a* of the oil filter 116. Oil is fed in the oil cooler 118 through the first passage portion 117*a* communicated to the outlet 116*b* of the oil filter 116, and is led to the main gallery 115 via a communication passage 119. The communication passage 119 is provided in the lower case 20 in such a manner as to be coaxially communicated to an outlet 118*b* provided at a center portion of oil cooler 118.

The sub-gallery 117 and the main gallery 115 in fluid communication with the outlet 118*b* of the oil cooler 118 are provided in the lower case 20 of the crankcase 21 in such a manner that the axes of each of the sub-gallery 117 and the main gallery 115 are parallel to that of the crankshaft 27. The discharge passage 114 is disposed under both the main gallery 115 and the sub-gallery 117 in such a manner that the axis of the discharge passage is perpendicular to the main gallery 115 and the sub-gallery 117. The center line of the sub-gallery 117, the center line of the main gallery 115, the center line of the communication passage 119, and the center axes of the oil filter 116 and the oil cooler 118 may all be located within the same plane.

As shown in FIG. 9, the oil filter 116 and the oil cooler 118 are mounted to an outer wall surface of the crankcase 21, e.g., on an outer wall surface of a front portion of the lower case 20 along the running direction of the motorcycle in this embodiment. A circular mounting seat 122, to which a housing 121 of the oil filter 116 is to be mounted, is provided on the outer wall surface of the lower case 20 of the crankcase 21. A circular outlet 116*b* in communication with the sub-gallery 117 is provided at a center portion of the mounting seat 122. An inlet 116*a* in communication with the discharge passage 114 is provided in the mounting seat 122 at a position eccentric from the outlet 116*b*.

A circular recess 123, in which part of a housing (not shown) of the oil cooler 118 is to be fitted, is provided in the outer wall surface of the lower case 20 at a position adjacent to the mounting seat 122. The first passage portion 117*a* of the sub-gallery 117 is opened in the inner side surface of the circular recess 123, and the opening portion is taken as an inlet 118*a* of the oil cooler 118. The outlet 118*b* is opened in a central portion of the circular recess 123, and the outlet 118*b* is communicated to the main gallery 115 via the communication passage 119.

An oil passage 124 extending upwardly from one end of the sub-gallery 117 is provided in the crankcase 21 on the one end side of the crankshaft 27 along the axial direction. The oil passage 124 is communicated to an oil passage 126 extending round in the cylinder head 23 via an oil passage 125 provided in the cylinder portion 17 of the cylinder block 19.

The oil passage 126 extending round in the cylinder head 23 includes a communication passage 127. The communication passage 127 is provided in a specific one of the plurality of the cam journal walls 81 and 82 provided in the cylinder head 23. The above specific cam journal wall is the cam journal wall 82 on the one end side of the crankshaft 27 in the axial direction. The communication passage 127 extends in a straight line so as to be communicated to the oil passage 125 provided in the cylinder portion 17.

As shown in FIG. 10, an annular groove 128 surrounding the exhaust side camshaft 80 is provided in both the cam journal wall 82 and the cam holder 84 fastened to the cam journal wall 82. The upper end of the above-described communication passage 127 is opened in the annular groove 128. A lubricating oil passage 129 closed at both ends of the exhaust side camshaft 80 is coaxially provided in the exhaust side camshaft 80. A communication hole 130 for communicating the annular groove 128 to the lubricating oil passage 129 is provided in the exhaust side camshaft 80. Lubricating oil holes 131, which have the outer ends opened in side surfaces of respective exhaust side cams 78 and the inner ends communicated to the lubricating oil passage 129, are provided in the exhaust side camshaft 80. Annular grooves 132 surrounding the exhaust side camshaft 80 are provided in the other cam journal walls 81 and the other cam holders 83. Communication holes 133 for communicating the lubricating oil passage 129 to the annular grooves 132 are provided in the exhaust side camshaft 80.

Oil led from the sub-gallery 117 is thus fed in the lubricating oil passage 129 provided in the exhaust side camshaft 80. The oil is then fed from the lubricating oil passage 129 to sliding-contact portions between the exhaust side cams 78 and the lifters 76 and sliding-contact portions between the exhaust side camshaft 80 and the cam journal walls 81 and 82 and the cam holders 83 and 84.

The oil passage 126 extending round in the cylinder head 23 passes through the sliding-contact portions between the intake side camshaft 79 and the exhaust side camshaft 80 and the cam journal wall 82 and the cam holder 84. It is to be noted that the cam journal wall 82 is the specific one of the plurality of cam journal walls 81 and 82 and the cam holder 84 is the specific one of the plurality of cam holders 83 and 84. The above-described annular groove 128 provided in the cam journal wall 82 and the cam holder 84 in such a manner as to surround the exhaust side camshaft 80 is communicated to an annular groove 134 provided in the cam journal wall 82 and the cam holder 84 in such a manner as to surround the intake side camshaft 79 by means of a communication groove 135 provided in at least one of the connection faces of the cam journal wall 82 and the cam holder 84 to the cylinder head 23 (the connection face of the cam holder 84 in this embodiment). A communication passage 136 communicated to the annular groove 134 is provided in a straight line in the cam journal wall 82 in such a manner as to extend in parallel to the communication passage 127.

The lubrication for the intake side camshaft 79 side is performed by the same lubricating structure as that of the exhaust side camshaft 80. Oil led from the annular groove 134 into the intake side camshaft 79 is fed to the sliding-contact portions between the intake side cams 77 and the lifters 75 and the sliding-contact portions between the intake side camshaft 79 and the cam journal walls 81 and 82 and the cam holders 83 and 84.

The oil passage 126 extending around in the cylinder head 23 includes a passage 137 provided in the cylinder head 23 in such a manner as to be communicated to the communication passage 127. The communication passage 137 is communicated to a passage 138 provided in the lifter housing 101 of the screw type lifter 94. The passage 138 is opened in the lifter housing 101. In this way, the downward end of the oil passage 126 extending round in the cylinder head 23 is communicated to the screw type lifter 94.

Oil fed through the oil passage 126 extending around in the cylinder head 23 is returned from the cylinder head 23 to the oil pan 22 side. As shown in FIG. 11, an upper surface 23*a* of the cylinder head 23 is formed into a triangular shape projecting upwardly in order to separate oil into the intake side camshaft 79 side and the exhaust side camshaft 80 side.

The oil having flowed from the intake side camshaft 79 side is returned to the oil pan 22 side through oil passages 139 and 140. The oil passages 139 and 140 are provided in the cylinder head 23 and the cylinder block 19 in such a manner as to be coaxial with each other. On the other side, the oil having flown on the exhaust side camshaft 80 side is returned to the oil pan 22 side by way of the inside of the generator chamber 65. A head side return oil passage 141 opened in the upper surface of the cylinder head 23 is provided in the cylinder head 23. A block side return oil passage 142 communicated to the head side return oil passage 141 is provided in the cylinder block 19 in such a manner as to be communicated to the inside of the generator chamber 65.

As particularly shown in FIG. 12, a branch oil passage 143 communicated to an intermediate portion of the block side return oil passage 142 is provided in the cylinder block 19. The branch oil passage 143 allows part of oil flowing in the block side return oil passage 142 to bypass the generator chamber 65 and to flow to the oil pan 22 side. The branch oil passage 143 is provided in the upper case portion 18 of the crankcase 21. A return oil passage 144 extending in the vertical direction is provided in the lower case 20 in such a manner that the upper end thereof is communicated to the branch oil passage 143 and the lower end thereof is opened in the oil pan 22.

The block side return oil passage 142 is opened to the connection face of the generator cover 64 to the cylinder block 19. A guide portion 145 for leading the oil having led from the block side return oil passage 142 to the stator 67 side of the generator 68 is formed in the generator cover 64.

As particularly shown in FIG. 13, the guide portion 145 includes a groove portion 145*a*, a gutter portion 145*b*, and a wall portion 145*c*. The groove portion 145*a* is provided in the inner side surface of the generator cover 64 with its one end communicated to the block side return oil passage 142. The groove portion 145*a* extends to the closed end side of the generator cover 64. The gutter portion 145*b* is formed at the lower edge of the groove portion 145*a*. The wall portion 145*c* is provided on the closed end of the generator cover 64 in such a manner as to extend radially inwardly from the other end of the groove portion 145*a*.

The function and operation of this embodiment will be described in greater detail hereinafter. The generator 68 and the over-running clutch 29 are dividedly disposed at both the ends of the crankshaft 27. This reduces the projecting amount of the engine body 15 on the generator 68 side, to allow the bank angle of the engine when the engine is mounted on a motorcycle to be set at a relatively large value. This also relatively reduces the projecting amount of the crankshaft 27 from the crankcase 21, to contribute the improvement of the engine output due to the increased engine speed.

On the figure projected on the plane perpendicular to the axis of the crankshaft 27, the starting motor 34 is disposed within an angular range surrounded by the cylinder axis C of the engine body 15 and the straight line connecting the crankshaft 27 to the main shaft 37, and more specifically, the starting motor 34 is mounted at an approximately central portion of the engine body 15 along the axis of the crankshaft 27. This prevents an imbalance in the weight of the engine along the axis of the crankshaft 27 from being caused by mounting of the starting motor 34.

The over-running clutch 29 is mounted to the one end portion of the crankshaft 27 at a position where the starting clutch 39 is sandwiched between the over-running clutch 29 and the starting motor 34 in the axial direction of the crankshaft 27. The starting gear reducer 35 is provided between the starting motor 34 and the over-running clutch 29. The starting gear reducer 35 includes the large-diameter gear 58 and the small-diameter gear 59 fixed to both the ends of the rotational shaft 62. The rotational shaft 62 crosses the starting clutch 39, and is rotatably supported by the engine body 15. This allows the starting clutch 39, e.g., the main shaft 37 of the transmission 36 to be disposed at a relatively high position, and hence to make the transmission structure between the crankshaft 27 and the transmission 36 more compact.

On a side view of the one end side of the crankshaft 27 in the axial direction, the starting motor 34 is disposed behind the starting clutch 38 in such a manner that part of the starting motor 34 is overlapped to the starting clutch 39. This allows the starting clutch 39, that is, the main shaft 37 of the transmission 36 to be disposed at a relatively high position, and hence to make the transmission structure between the crankshaft 27 and the transmission 36 compact.

The main gallery 115 connected to the discharge port of the oil pump 108 via the oil filter 116 and the oil cooler 118 is provided in the crankcase 21. The sub-gallery 117 connected to the outlet 116*b* of the oil filter 116 in parallel to the main gallery 115 so as to introduce oil to the cylinder head 23 side is provided in the crankcase 21. The oil to be fed to the cylinder head 23 side is led to the sub-gallery 117 that is fluid communication with the outlet 116*b* of the oil filter 116 and in parallel with the main gallery 115. This makes it possible to divide oil into at least two parts and feed the divided parts of oil to portions to be lubricated of the engine, and hence to equally feed oil to each portion to be lubricated. This is effective to sufficiently feed oil to the cylinder head 23 side without increasing a pressure loss of the oil. Another advantage is simplifying the passage configuration from the sub-gallery 117 to the cylinder head 23 by taking the sub-gallery 117 as a passage specialized to feed oil to the cylinder head 23 side.

The sub-gallery 117 includes the first passage portion 117*a* and the second passage portion 117*b*. The first passage portion 117*a* extends in a straight line so as to communicate the outlet 116*b* of the oil filter 116 to the oil cooler 118. The second passage portion 117*b* extends in a straight line in the direction opposite to that of the first passage portion 117*a*. This is advantageous in simplifying the shape of the sub-gallery 117, thereby facilitating the formation of the sub-gallery 117.

The sub-gallery 117 and the main gallery 115 are communicated with the outlet 118*b* of the oil cooler 118 and are provided in the crankcase 21 in such a manner that the axes thereof are parallel to the axis of the crankshaft 27. This is advantageous, in addition to the above-described simplification of the sub-gallery 117, in simplifying the shape of the main gallery 115, thereby facilitating the formation of the main gallery 115.

The center line of the sub-gallery 117, the center line of the main gallery 115, the center line of the communication passage 119 for communicating the outlet 118*b* of the oil cooler 118, and the center axes of the oil filter 116 and the oil cooler 118 are all located within the same plane. This facilitates the formation of the passages in the crankcase 21.

The discharge port 114 for connecting the oil pump 108 to the oil filter 116 is disposed under both the main gallery 115 and the sub-gallery 117 in such a manner that the axis thereof is perpendicular to the main gallery 115 and the sub-gallery 117. This allows the sub-gallery 117, the main gallery 115, and the discharge port 114 to be compactly disposed along the vertical direction.

The oil filter 116 and the oil cooler 118 are mounted on the outer wall surface of the crankcase 21 in such a manner as to be disposed in parallel. This allows the oil filter 116 and the oil cooler 118 to be compactly mounted to the crankcase 21 by making the distance between the axes of the oil filter 116 and the oil cooler 118 as short as possible.

A rotational power is transmitted from the crankshaft 27 to the intake side camshaft 79 and the exhaust side camshaft 80 by means of the timing transmission 85 having the cam chain 89. The screw lifter 94 having the lifter rod 103 with its one end being in contact with the tensioner arm 92 that is in sliding-contact with the cam chain 89 is provided in the cylinder head 23. The oil passage 126 to which oil is fed from the oil pump 108 is formed so as to extend around within the cylinder head 23, and the downstream end of the oil passage 126 is communicated with the screw type lifter 94.

With this configuration, it is possible to prevent the pressure of oil fed from the oil pump 108 to the oil passage 126 extending round in the cylinder head 23 from being reduced during mid-flow, and to reliably feed oil to the screw type lifter 94. The oil passage 126 extending around the cylinder head 23 is formed so as to pass through the sliding-contact portions between the intake side camshaft 79 and the exhaust side camshaft 80 and the cam journal wall 82 as one of the plurality of the cam journal walls 81 and 82 and the cam holder 84 fastened to the cam journal wall 82. This is effective to certainly lubricate the intake side camshaft 79 and the exhaust side camshaft 80.

The oil passage 126 extending around in the cylinder head 23 includes the pair of annular grooves 128 and 134, the communication groove 135, and the pair of communication passages 127 and 136. The pair of annular grooves 128 and 134 are provided in the cam journal wall 82 and the cam holder 84 formed so as to rotatably support the intake side camshaft 79 and the exhaust side camshaft 80 in common. The annular grooves 128 and 134 are formed to surround the camshafts 79 and 80, respectively. The communication groove 135 is provided in at least one of the connection faces of the cam journal wall 82 and the cam holder 84 to the cylinder head 23 in such a manner as to connect the annular groove 128 to the annular groove 134. The pair of communication passages 127 and 136 are provided in straight line in the cam journal wall 82 in such a manner as to be communicated to the annular grooves 128 and 134, respectively. With this configuration, of the oil passage 126 extending around in the cylinder head 23, oil passage portions for lubricating the intake side camshaft 79 and the exhaust side camshaft 80 can be easily formed.

Oil is fed from the sub-gallery 117 independent from the main gallery 115 to the oil passage 126 extending around in the cylinder head 23. This prevents the pressure of oil to be fed to the main gallery 115 from being affected by feeding of oil in the cylinder head 23. The block side return oil passage 142 communicated to the head side return oil passage 141 provided in the cylinder head 23 is provided in the cylinder block 19 in such a manner as to be communicated to the inside of the generator chamber 65 and to return oil from the cylinder head 23 to the oil pan 22 side through the generator chamber 65. The branch oil passage 143 communicated to the intermediate portion of the block side return oil passage 142 is provided in the cylinder block 19. The branch oil passage 143 is formed so as to allow part of oil flowing in the block side return oil passage 142 to bypass the generator chamber 65 and to flow to the oil pan 22 side.

Part of the oil led to the block side return oil passage 142 through the head side return oil passage 141 is branched to the branch oil passage 143 side, to flow to the oil pan 22 side while bypassing the generator chamber 65. With this configuration, it is possible to suppress the amount of oil led in the generator chamber 65 to a suitable value, and to comparatively reduce the agitating resistance of oil due to rotation of the rotor 66 of the generator 68. This is advantageous in preventing the oil temperature from being raised and an increase in friction loss.

The branch oil passage 143 is provided in the upper case portion 18 of the lower side of the cylinder block 19. The return oil passage 144 with its upper end communicated to the branch oil passage 143 and its lower end opened in the oil pan 22 is provided in the lower case 20 forming the crankcase 21 in cooperation with the upper case portion 18 in such a manner as to extend in the vertical direction. Accordingly, the oil having flown in the branch oil passage 143 can be certainly led to the oil pan 22.

The guide portion 145 for leading the oil having led from the block side return oil passage 142 to the inside of the generator chamber 65 to the stator 67 side is provided on the inner surface of the generator cover 64. As a result, the oil having led in the generator chamber 65 can be used only for cooling the stator 67 by eliminating the contact of the oil with the rotor 66 as much as possible. This makes it possible to realize effective cooling and to effectively reduce the agitating resistance of oil due to rotation of the rotor 66.

As described above, it is possible to divide the oil into at least two parts and feed the divided oil part to each of portions to be lubricated in the engine, and hence to equally feed oil to each of the portions to be lubricated in the engine. This is advantageous in sufficiently feeding oil even to the cylinder head side while avoiding the increased pressure loss of oil. In addition, the oil passage configuration from the sub-gallery to the cylinder head can be simplified by taking the sub-gallery as a passage specialized to feed oil to the cylinder head side.

In addition, it is possible to facilitate the formation of the sub-gallery by simplifying the shape of the sub-gallery and to facilitate the formation of the main gallery by simplifying the shape of the main gallery. It is also possible to facilitate the formation of the oil passage configuration in the crankcase. The sub-gallery, the main gallery, and the discharge passage may be compactly disposed with respect to a vertical direction, and the the oil filter and the oil cooler may be mounted on the crankcase by making the distance of the axes of the oil filter and the oil cooler as short as possible.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating system for an engine, said lubricating system comprising:

an oil pump connected to an oil filter via a discharge port of the oil pump;

a main gallery being connected to the discharge port of the oil pump via the oil filter, wherein said main gallery is provided in a crankcase of the engine;

a sub-gallery for leading oil to a cylinder head side of the lubricating system, said sub-gallery being provided in said crankcase in such a manner as to be operatively connected to an outlet of said oil filter and in parallel to said main gallery;

an oil cooler operatively connected to said sub-gallery and said main-gallery, wherein oil flowing through said main gallery is in parallel flow to oil flowing in said sub-gallery, and wherein a center line of said sub-gallery, a center line of said main gallery, a center line of a communication passage for communicating said outlet of said oil cooler to said main gallery, and a center axis of said oil filter and a center axis of said oil cooler are all located within the same plane.

2. The lubricating system according to claim 1, wherein said sub-gallery includes a first passage portion extending in a straight line so as to communicate said outlet of said oil filter with the oil cooler, and a second passage portion extending in a straight line in a direction opposite to the direction of said first passage portion.

3. The lubricating system according to claim 1, wherein said sub-gallery and said main gallery each have a longitudinal axis and are provided in said crankcase, said longitudinal axes of said sub-gallery and said main gallery being in with parallel an axis of rotation of said crankshaft.

4. The lubricating system according to claim 2, wherein said sub-gallery and said main gallery each have a longitudinal axis and are provided in said crankcase, said longitudinal axes of said sub-gallery and said main gallery being in with parallel an axis of rotation of said crankshaft.

5. The lubricating system according to claim 4, wherein a discharge passage for connecting said oil pump to said oil filter is disposed in a position beneath said main-gallery and said sub-gallery in such a manner that an axis of said discharge passage is perpendicular to the longitudinal axes of said main-gallery and said sub-gallery.

6. The lubricating system according to claim 2, wherein said oil filter and said oil cooler are mounted in parallel to an outer wall surface of said crankcase.

7. A lubricating device for an engine having a crankcase, said lubricating device comprising:

an oil pump connected to an oil filter via a discharge port of the oil pump;

a main gallery being connected to the discharge port of the oil pump via the oil filter, wherein said main gallery is provided in the crankcase of the engine;

a sub-gallery for leading oil to a cylinder head side of the lubricating device, said sub-gallery being provided in said crankcase in such a manner as to be operatively connected to an outlet of said oil filter and in parallel to said main gallery;

an oil cooler operatively connected to said sub-gallery and said main-gallery, wherein oil flowing through said main gallery is in parallel flow to oil flowing in said sub-gallery, and wherein a center line of said sub-gallery, a center line of said main galley, a center line of a communication passage for communicating said outlet of said oil cooler to said main gallery, and a center axis of said oil filter and a center axis of said oil cooler are all located within the same plane.

8. The lubricating device according to claim 7, wherein said sub-gallery includes a first passage portion extending in a straight line so as to communicate said outlet of said oil filter with the oil cooler, and a second passage portion extending in a straight line in a direction opposite to the direction of said first passage portion.

9. The lubricating device according to claim 7, wherein a discharge passage for connecting said oil pump to said oil filter is disposed in a position beneath said main-gallery and said sub-gallery in such a manner that an axis of said discharge passage is perpendicular to the longitudinal axes of said main-gallery and said sub-gallery.

10. A lubricating system for an engine, said lubricating system comprising:

an oil pump connected to an oil filter via a discharge port of the oil pump;

a main gallery being connected to the discharge port of the oil pump via the oil filter, wherein said main gallery is provided in a crankcase of the engine;

a sub-gallery extending parallel to the main gallery, said sub-gallery including a first passage portion extending in a straight line so as to communicate an outlet of said oil filter with an oil cooler, and a second passage portion extending in a straight line in a direction opposite to the direction of said first passage portion;

an oil passage extending upwardly from an end of the sub-gallery to a cylinder head for leading oil to a cylinder head side of the lubricating system and;

an oil cooler operatively connected to said sub-gallery and said main gallery;

wherein a center line of said sub-gallery, a center line of said main gallery, a center line of a communication passage for communicating said outlet of said oil cooler to said main gallery, and a center axis of said oil filter and a center axis of said oil cooler are all located within a same plane.

* * * * *